US007290767B2

(12) United States Patent
Wilk et al.

(10) Patent No.: US 7,290,767 B2
(45) Date of Patent: Nov. 6, 2007

(54) ACTION FIGURE GAME PIECE AND METHOD OF PLAYING ACTION FIGURE GAME

(75) Inventors: Brian M. Wilk, Seekonk, MA (US); David F. Kunitz, Barrington, RI (US); Thomas C. McCarthy, Warren, RI (US); Henry S. Winters, Pawtucket, RI (US)

(73) Assignee: Hasbro, Inc., Pawtucket, RI (US)

( * ) Notice: Subject to any disclaimer, the term of this patent is extended or adjusted under 35 U.S.C. 154(b) by 0 days.

(21) Appl. No.: 11/053,355

(22) Filed: Feb. 8, 2005

(65) Prior Publication Data

US 2005/0133997 A1 Jun. 23, 2005

Related U.S. Application Data

(62) Division of application No. 10/643,526, filed on Aug. 19, 2003, now Pat. No. 7,104,543.

(51) Int. Cl.
*A63F 3/00* (2006.01)

(52) U.S. Cl. ..... 273/288; 446/268

(58) Field of Classification Search ..... 273/288; 446/268

See application file for complete search history.

(56) References Cited

U.S. PATENT DOCUMENTS

| | | | | |
|---|---|---|---|---|
| 1,222,551 A | | 5/1917 | MacPherson | |
| 2,052,035 A | * | 8/1936 | Potter | 273/317.3 |
| 2,610,060 A | | 9/1952 | Powell | 273/131 |
| 3,222,068 A | | 12/1965 | Cowels, Jr. | 273/134 |
| 3,945,640 A | | 3/1976 | Denmark | 273/85 R |
| 4,039,188 A | | 8/1977 | Goldfarb et al. | 273/101 |

(Continued)

FOREIGN PATENT DOCUMENTS

| | | |
|---|---|---|
| EP | 0 850 671 | 7/1998 |

OTHER PUBLICATIONS

International Search Report, International Application No. PCT/US2004/011557, search completed Oct. 4, 2004.

(Continued)

*Primary Examiner*—Vishu Mendiratta
(74) *Attorney, Agent, or Firm*—Marshall, Gerstein & Borun LLP

(57) ABSTRACT

An action figure game piece is disclosed. The game piece comprises a game figure character adapted for movement a distance over a surface and a mechanism for indicating the distance of movement over the surface. A method of playing an action figure game on the surface is also disclosed. The method comprises providing for each player a plurality of the game pieces, each game piece having an indicium indicating a point value, a mechanism for indicating a distance the game piece has moved over the surface, and a mechanism for attacking an opponent player's game pieces. The method also comprises selecting for each player a group of the game pieces having point values summing to a predetermined value and selecting a number of actions each player can take per player's turn. An action comprises either a move, comprising moving a game piece a distance up to the particular game piece's point value, or an attack, comprising actuation of the particular game piece's attacking mechanism. Players alternate taking turns, selectively making a move or an attack, until the game is determined to have ended.

18 Claims, 4 Drawing Sheets

U.S. PATENT DOCUMENTS

| | | | | |
|---|---|---|---|---|
| 4,083,564 | A | 4/1978 | Matsumoto | 273/239 |
| 4,211,408 | A | 7/1980 | Tickle | 273/85 R |
| 4,317,570 | A | 3/1982 | Brunton | 273/246 |
| 4,515,371 | A * | 5/1985 | Basevi | 273/260 |
| 4,783,080 | A | 11/1988 | Rosenwinkel et al. | 273/255 |
| 4,906,825 | A | 3/1990 | Wu | 235/95 R |
| 5,009,424 | A | 4/1991 | Harth et al. | 273/85 D |
| 5,042,807 | A | 8/1991 | Sasakawa et al. | 273/85 C |
| 5,211,403 | A | 5/1993 | Ostrander | 273/290 |
| 5,344,156 | A | 9/1994 | Levin | 273/355 |
| D389,872 | S | 1/1998 | Rhea | D21/16 |
| 5,879,005 | A | 3/1999 | Baca | 273/255 |
| 6,332,616 | B1 | 12/2001 | Brown | 273/440.1 |
| 6,446,966 | B1 * | 9/2002 | Crozier | 273/236 |
| 6,659,463 | B2 | 12/2003 | Mackey | 273/276 |
| 2002/0180150 | A1 | 12/2002 | Weisman | 273/236 |
| 2003/0220044 | A1 | 11/2003 | Andrews et al. | 446/268 |
| 2004/0119234 | A1 | 6/2004 | Mackey | 273/276 |
| 2005/0017450 | A1 * | 1/2005 | Weisman et al. | 273/288 |

OTHER PUBLICATIONS

U.S. Appl. No. 09/479,531, filed Jan. 7, 2000 and listing Thomas J. Mackey as inventor.

* cited by examiner

ACTION FIGURE GAME PIECE AND METHOD OF PLAYING ACTION FIGURE GAME

CROSS REFERENCE TO RELATED APPLICATION

The present application is a divisional patent application of U.S. patent application Ser. No. 10/643,526 filed on Aug. 19, 2003 now U.S. Pat. No. 7,104,543.

BACKGROUND OF THE INVENTION

Action figure games typically require game boards for play. This can make the portability of the game more difficult.

The present invention is provided to solve this and other problems.

SUMMARY OF THE INVENTION

It is an object of the invention to provide an action figure game piece.

In accordance with the invention, the game piece comprises a game figure character adapted for movement a distance over a surface and means for indicating the distance of movement over the surface.

It is contemplated that the distance indicating means provides an audible and/or visual indication of the distance. In particular, the distance indicating means may comprise an axle, a wheel fixedly secured to the axle and adapted for rotary engagement with the surface, to rotate the axle upon movement of the game piece over the surface, and means for indicating progressive rotation of the axle.

It is further contemplated that the game piece includes means for attacking another game piece. The attacking means may comprise a means for launching a projectile. Alternatively, the attacking means may comprise a spring, a striking portion, and means for permitting rotation of the striking portion of the game piece in a first direction relative to the spring to bias the striking portion, such that the striking portion will rotate in a second, opposite direction upon release.

It is a further object of the invention to provide a method of playing an action figure game on a surface.

In accordance with this aspect of the invention, the method comprises providing for each player a plurality of game pieces, each game piece having an indicium indicating a point value, a means for indicating a distance the game piece has moved over the surface, and a means for attacking an opponent player's game pieces. The method further comprises selecting for each player a group of the game pieces having point values summing to a predetermined value, and selecting a number of actions each player can take per player's turn. An action comprises either a move, comprising moving a game piece a distance up to the particular game piece's point value, or an attack, comprising actuation of the particular game piece's attacking means. The players alternate taking turns, selectively making a move or an attack, until the game is determined to have ended.

It is contemplated that a game piece is removed from the game if the game piece is determined to have been killed by an attack.

It is further contemplated that at least one of each game piece in each of the plurality of game pieces includes means for randomly providing the player with a reward if that particular game piece is killed.

It is still further contemplated that the plurality of game pieces includes at least one game piece having a close-acting attacking means and at least one game piece having a distance-acting attacking means.

Other features and advantages will be apparent from the following specification taken in conjunction with the following drawings.

DETAILED DESCRIPTION OF A PREFERRED EMBODIMENT

A first embodiment of an action figure game piece 10 is illustrated in FIGS. 1-7. The game piece 10 comprises a game figure character 12 and a base portion 14. The base portion 14 is adapted for movement a distance over a surface, such as a table top, not shown. The game piece 10 includes a mechanism, described below, disposed within the base portion 14 for audibly and visually (such as for the hearing impaired) indicating the distance of movement of the game piece 10 over the surface. The game piece 10 further includes a mechanism, also described below, for attacking another game piece.

Figure 2:
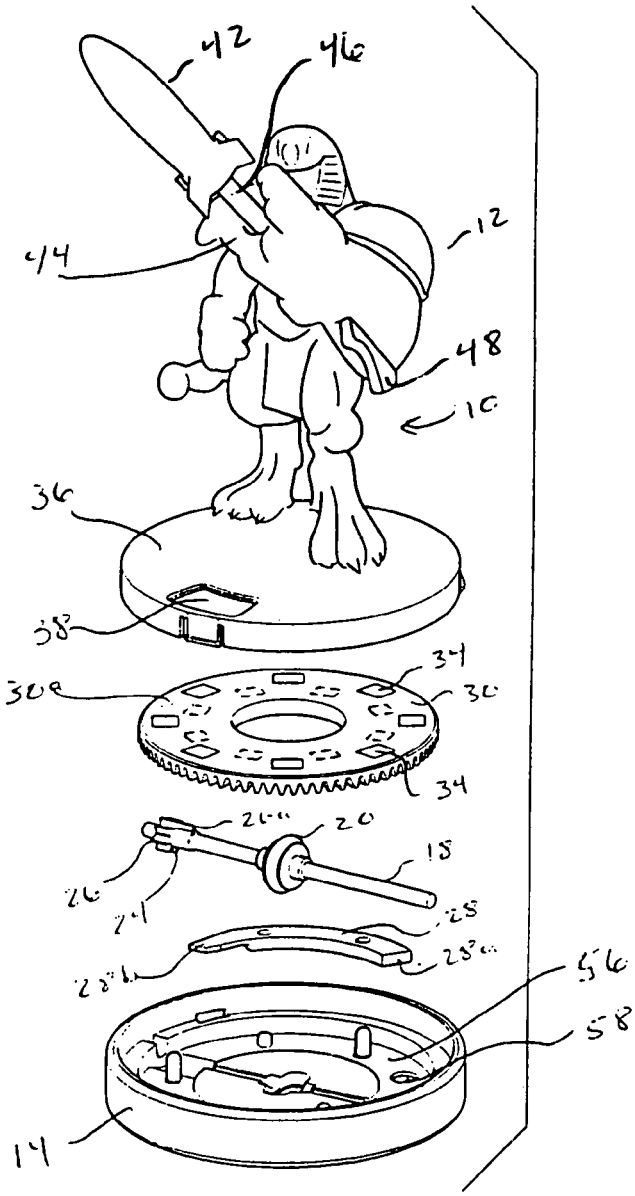
FIG. 2 is an exploded view of the action figure of FIG. 1.
Figure 3:
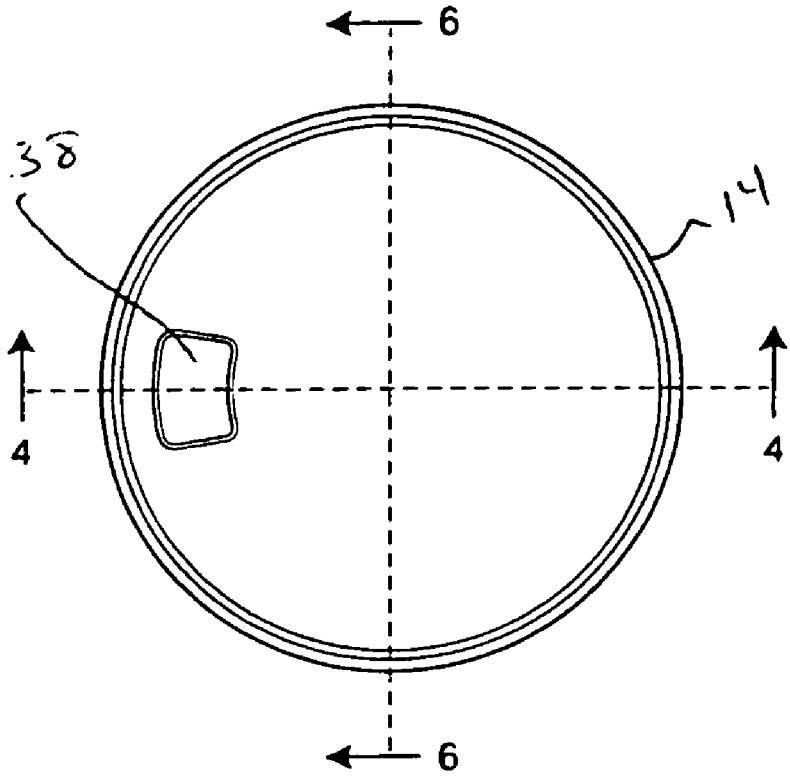
FIG. 3 is a plan view of a base portion of the action figure of FIG. 1.
Figure 4:
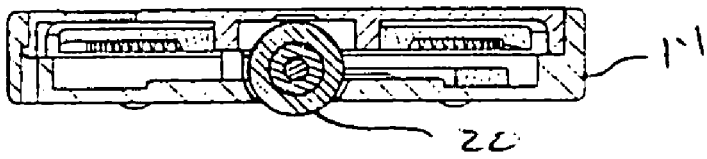
FIG. 4 is a sectional view taken along line 4-4 of FIG. 3.
Figure 5:
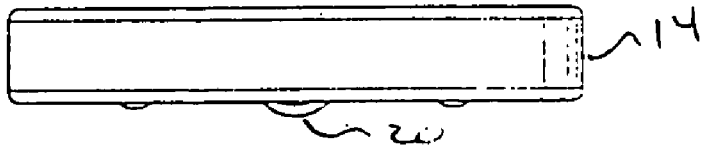
FIG. 5 is a view of one side of the base portion of FIG. 3.
Figure 6:
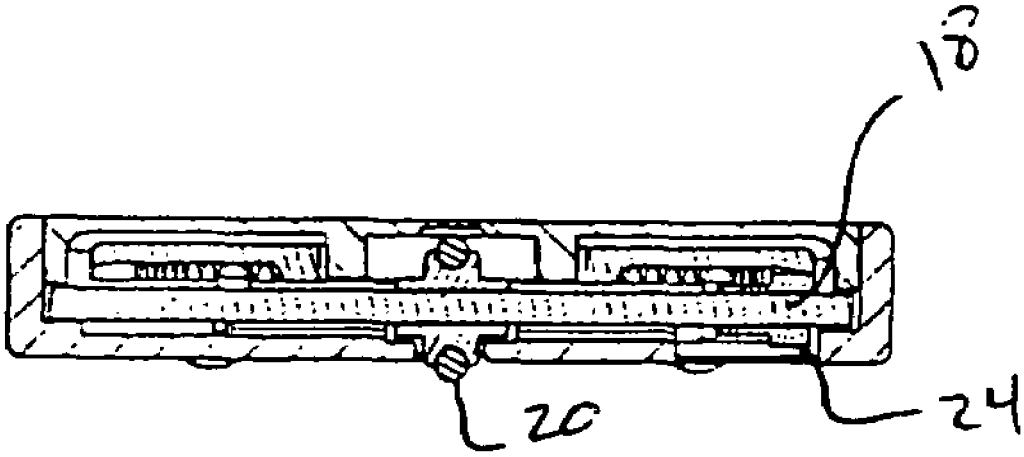
FIG. 6 is a sectional view taken along line 6-6 of FIG. 3.
Figure 7:
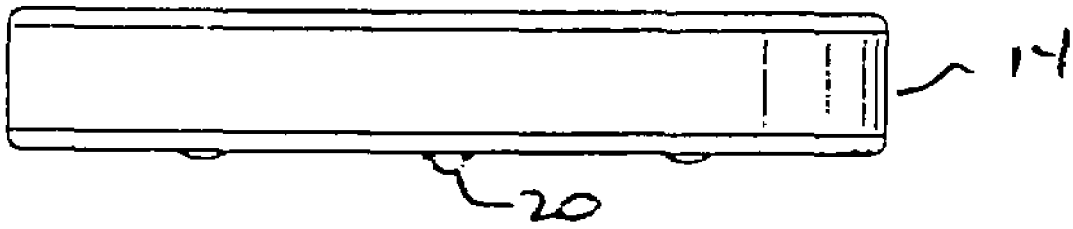
FIG. 7 is a view of another side of the base portion of FIG. 3.

As shown in FIGS. 2, 4 and 6, the mechanism for audibly indicating the distance of movement comprises an axle 318, a wheel 20 fixedly secured to the axle 18 and adapted for rotary engagement with the surface to rotate the axle 18 upon movement of the game piece 10 over the surface. The mechanism further includes a pinion gear 24 fixedly secured to the axle 18 and including a plurality of teeth 26. One of the teeth 26 has a tooth extension 26*a*. A clicker 28 has a first end 28*a* secured to the base portion 14 and a second end 28*b* engaging the pinion gear 24. Rotation of the wheel 20 as the game piece 10 is moved over the surface rotates the tooth extension 26*a* against the clicker second end 28*b*, providing an audible clicking sound once per revolution of the axle 18.

The mechanism for visually indicating the distance of movement comprises a circular rack 30 engaging the pinion gear 24. The circular rack 30 includes an upper surface 30*a* and a lower surface 30*b*. The upper surface 30*a* has circumferentially spaced first red marks 34. An upper, black faceplate 36 is disposed on the base portion 14 adjacent the rack surface 30*a*. The upper faceplate 36 has a first visual aperture 38 radially aligned with the first red marks 34 to sequentially display movement of the first red marks as the rack 30 rotates. The number of first red marks passing by the aperture 38 indicates the distance traveled.

Figure 1:
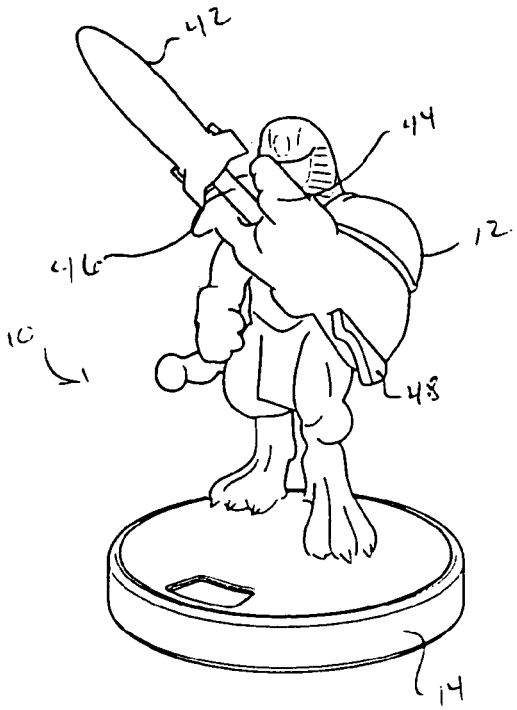
FIG. 1 is a perspective of one embodiment of an action figure in accordance with the invention.

The game piece 10 has a mechanism for attacking another game piece. This attack mechanism is a distance-acting attack mechanism, as illustrated in FIGS. 1 and 2. The distance acting attack mechanism is conventional and launches a projectile 42 from a barrel 44. The barrel 44 has an internal spring (not shown). The projectile 42 has a tab 46. When a portion of the projectile 42 including the tab 46 is inserted into the barrel 44, the projectile 42 compresses the spring, and the tab 46 engages a catch (not shown) within the barrel 44, retaining the projectile 42 in the barrel 44 against the bias of the compressed spring. When actuated, a trigger 48, coupled to the catch, releases the catch from the tab 46, permitting the compressed spring to launch the projectile 42 a distance from the barrel 44.

Figure 8:
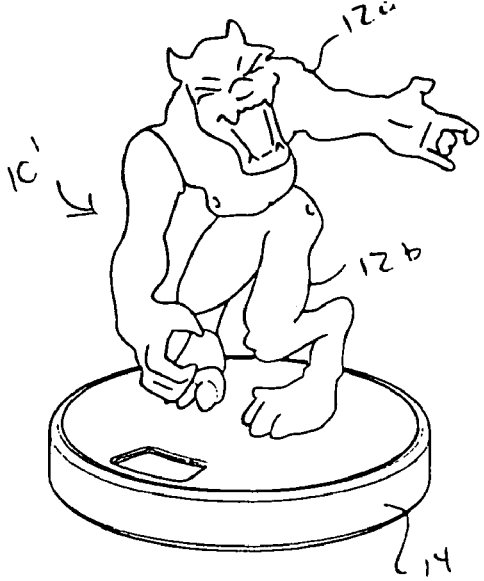
FIG. 8 is a perspective of a second embodiment of an action figure in accordance with the invention.
Figure 9:
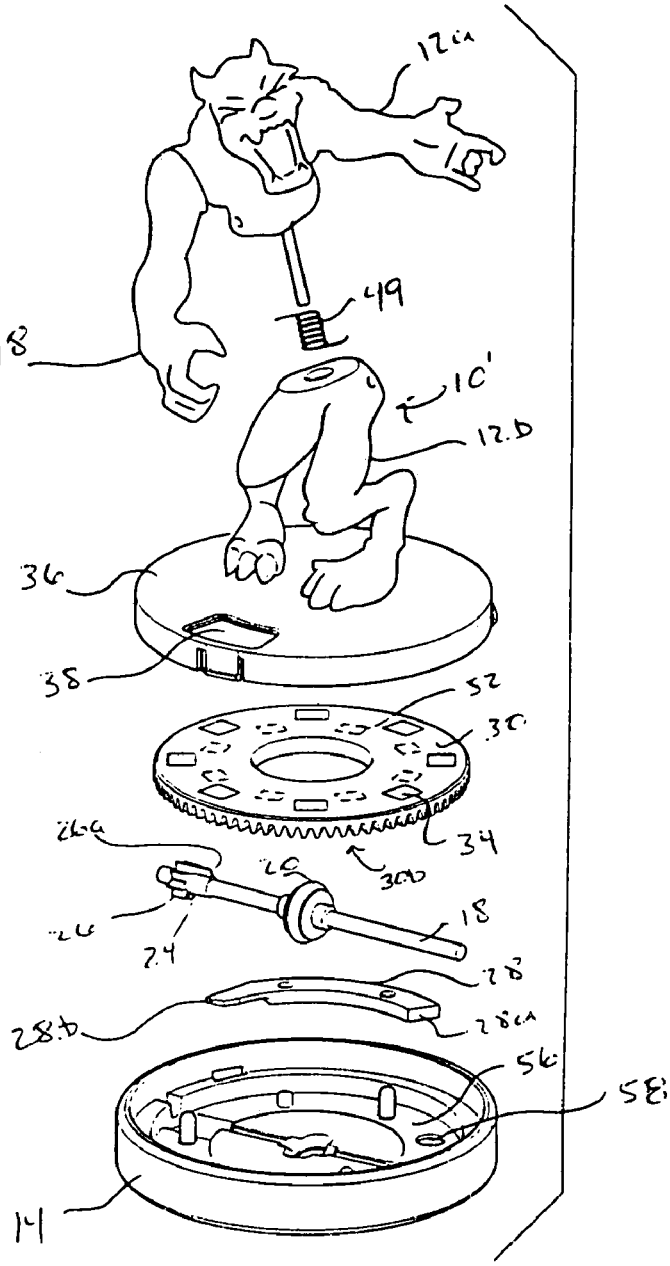
FIG. 9 is an exploded view of the action figure of FIG. 8.

A second embodiment of a game piece 10' is illustrated in FIGS. 8 and 9. Similar components have the same reference numbers as the first embodiment 10, the only difference being the attack mechanism. The second embodiment of the game piece 10' has a close-acting attack mechanism. The close-acting attack mechanism permits a portion of the game piece 10 to strike another game piece 10. The game FIG. 12 utilizing this attack mechanism has an upper portion 12*a*, having a striking portion 48, which is rotatably mounted to a lower portion 12*b*. A spring 49 is disposed between the upper portion 12*a* and the lower portion 12*b*, holding the upper portion 12*a* at an equilibrium position relative to the lower portion 12*b*. When the upper portion 12*a* is rotated in a first direction relative to the lower portion 12*b*, the spring 49 is compressed. When released, the upper portion 12*a* rapidly rotates in a second, opposite direction relative to the lower portion 12*b* to the equilibrium position, causing the striking portion 48 to strike anything in its path, such as an adjacent game piece opponent.

The game piece 10 also includes a mechanism for alternatively displaying and shielding a series of second red marks 52 (in phantom), indicative of the presence or absence of a special characteristic of the game piece. The series of second red marks 52 are circumferentially spaced on the lower surface 30*b*. A second faceplate 56 is disposed on the base portion 14 adjacent the lower surface 30*b*. The second faceplate 56 has a visual aperture 58 radially aligned with the series of second red marks to alternatively display the presence or absence of the second series of red marks 52.

The method of playing an action figure game on the surface is as follows. Each player is initially provided with a plurality of the game pieces 10, 10' forming a pool of the game pieces 10, 10'. Each of the game pieces 10, 10' has a number indicating a particular point value. Different ones of the game pieces 10, 10' have different point values. Each of the game pieces 10, 10' has the distance indicating mechanism, and one of the attack mechanisms, described above. Each player initially selects a group of the game pieces 10, 10' from the player's respective pool, having point values summing to a predetermined value. This group will be the player's team. Any number of players may play.

During play, each player sequentially takes a turn. For each turn, each player can take a predetermined number of actions, for example, three. An action is either: (1) a move, comprising moving one of the player's game pieces 10, 10' a distance up to the particular game piece's point value; or (2) an attack, comprising actuation of the particular game piece's attack mechanism against one of an opponent's game pieces 10, 10'. During a turn, there may be limitations of how many total moves or attacks can be taken. For example if three actions are permitted, players may be limited to no more than two moves (and one attack) or two attacks (and one move) per turn.

A game piece 10, 10' is removed from the game if the game piece 10, 10' is determined to have been killed by an attack, such as being knocked over in response to an opponent's attack. The players sequentially take turns, selectively making a move or an attack, until the game is determined to have ended, such as when all of a player's game figures have been killed, or upon completion of a particular time period. The winner is determined by summing the point values of each players remaining game pieces.

According to the method, if a player's game piece 10, 10' is killed when one of its second red marks is present, the player is awarded in accordance with a message on the underside of the base portion 14. For example, the game piece 10, 10' may be permitted to re-enter the game. Or the player may add a different game piece 1-, 10' to the game.

Modifications and alternative embodiments of the invention will be apparent to those skilled in the art in view of the foregoing description. This description is to be construed as illustrative only, and is for the purpose of teaching those skilled in the art the best mode of carrying out the invention. The details of the structure and method may be varied substantially without departing from the spirit of the invention, and the exclusive use of all modifications which come within the scope of the appended claims is reserved.

What is claimed is:

1. A method of playing an action figure game on a surface, the method comprising:

providing for each player a plurality of game pieces, each game piece having an indicium indicating a point value, a distance measuring device for indicating a distance the game piece has moved over the surface, and a weapon that is actuated for attacking an opponent's game pieces, wherein each of the plurality of game pieces includes at least one game piece having a close-acting weapon and at least one game piece having a distance-acting weapon;

selecting for each player a group of the game pieces having point values summing to a predetermined value;

selecting a number of actions each player can take per player's turn, an action comprising either a move, comprising moving a game piece a distance up to the particular game piece's point value with the distance being measured by the distance measuring device of the moved game piece, or an attack, comprising actuation of the particular game piece's weapon; and removing a game piece from the game if the game piece is determined to have been killed by an attack, wherein the players alternate taking turns, selectively making a move or an attack, until the game is determined to have ended.

2. The method of claim 1 wherein at least one of each game piece in each of the plurality of game pieces includes a reward indicator for randomly providing the player with a reward if that particular game piece is killed.

3. The method of claim 1 wherein each game piece has an upright orientation in which the game piece may be disposed on the surface, and wherein a game piece is killed if the game piece is engaged by an actuated weapon of an opposing player's game piece in a manner that causes the game piece to move from its upright orientation to a fallen orientation.

4. The method of claim 1, wherein the game ends upon completion of a predetermined time period.

5. The method of claim 1 wherein the game ends upon elimination of all of one of the player's game pieces.

6. The method of claim 1 wherein any particular game piece can perform multiple actions per turn.

7. The method of claim 1 wherein each player may take up to a predetermined number of actions per turn.

8. The method of claim 7 wherein the number of actions per turn is three.

9. The method of claim 7 wherein each player can take no more than two actions or moves per turn.

10. A method of playing an action figure game on a surface, the method comprising:

selecting by each player a plurality of game pieces of the action figure game, each game piece having an associated point value, and wherein each player selects the plurality of game pieces such that the point values associated with the selected game pieces sum to a predetermined total point value, wherein each game piece includes a mechanically actuatable attack mechanism that is actuated for attacking another game piece by physical engagement;

each player in turn taking up to a predetermined number of actions with the player's game pieces, wherein each action is one of moving a game piece over the surface and performing an attack action against another player's game piece with one of the player's game pieces, wherein the action of performing an attack action comprises actuating the attack mechanism of the player's game piece in the direction of an opposing player's game piece;

removing a player's game piece from the game if the game piece is killed in accordance to game rules due to physical engagement by the attack mechanism of an opposing player's game piece during an attack action;

alternately displaying and shielding special character indicia of the game pieces as the game pieces move across the surface; and providing a player with a game award in accordance with the special character indicia of the game piece if the special character indicia are displayed when the game piece is killed.

11. The method of claim 10, wherein the action of moving a game piece over the surface comprises moving the game piece over the surface a distance less than or equal to a maximum distance corresponding to the point value associated with the game piece.

12. The method of claim 10, wherein each game piece has an upright orientation in which the game piece may be disposed on the surface, the method comprising removing a player's game piece from the game if the game piece is engaged by an opposing player's game piece during the opposing player's attack action in a manner that causes the game piece to move from its upright orientation to a fallen orientation.

13. The method of claim 10, comprising calculating a final point value for each player equal to the point values for the player's remaining game pieces at the end of the game, wherein the player having the greatest final point value is the winner of the game.

14. A method of playing an action figure game on a surface, the method comprising:

selecting by each player a plurality of game pieces of the action figure game, each game piece having an associated point value, and wherein each player selects the plurality of game pieces such that the point values associated with the selected game pieces sum to a predetermined total point value, wherein each game piece includes a mechanically actuatable attack mechanism that is actuated for attacking another game piece by physical engagement;

each player in turn taking at least one action with at least one of the player's game pieces, wherein each action is one of moving a game piece over the surface and performing an attack action against another player's game piece with one of the player's game pieces, wherein the action of performing an attack action comprises actuating the attack mechanism of the player's game piece in the direction of an opposing player's game piece;

removing a player's game piece from the game if the game piece is killed in accordance to game rules due to physical engagement by the attack mechanism of an opposing player's game piece during an attack action;

alternately displaying and shielding special character indicia of the game pieces as the game pieces move across the surface; and providing a player with a game award in accordance with the special character indicia of the game piece if the special character indicia are displayed when the game piece is killed.

15. The method of claim 14, wherein the action of moving a game piece over the surface comprises moving the game piece over the surface a distance less than or equal to a maximum distance corresponding to the point value associated with the game piece.

16. The method of claim 14, wherein each game piece has an upright orientation in which the game piece may be disposed on the surface, the method comprising removing a player's game piece from the game if the game piece is engaged by an opposing player's game piece during the opposing player's attack action in a manner that causes the game piece to move from its upright orientation to a fallen orientation.

17. The method of claim 14, comprising calculating a final point value for each player equal to the point values for the player's remaining game pieces at the end of the game, wherein the player having the greatest final point value is the winner of the game.

18. The method of claim 14, comprising each player in turn taking a predetermined number of actions with player's game pieces.

* * * * *